US005209601A

United States Patent [19]

Odill et al.

[11] Patent Number: 5,209,601

[45] Date of Patent: May 11, 1993

[54] MANHOLE GRADE ADJUSTING RING AND METHOD

[75] Inventors: Frank J. Odill, West Allis; Ronald E. Anderson, Fort Atkinson, both of Wis.

[73] Assignee: Cretex Companies, Inc., Elk River, Minn.

[21] Appl. No.: 743,615

[22] Filed: Aug. 14, 1991

[51] Int. Cl.[5] ..... E02B 29/14

[52] U.S. Cl. ..... 404/26; 52/20

[58] Field of Search ..... 404/25, 26; 52/19, 20, 52/21

[56] References Cited

U.S. PATENT DOCUMENTS

| | | | |
|---|---|---|---|
| 2,431,082 | 11/1947 | Sayles | 94/34 |
| 3,611,889 | 10/1971 | Levinson | 94/34 |
| 3,891,337 | 6/1975 | McCoy | 404/26 |
| 3,958,313 | 6/1976 | Rossborough | 29/157 |
| 4,097,171 | 6/1978 | Fier | 404/26 |
| 4,225,266 | 9/1980 | Fier | 404/26 |
| 4,281,944 | 8/1981 | Bowman | 404/26 |
| 4,302,126 | 11/1981 | Fier | 404/26 |
| 4,582,450 | 4/1986 | Neil | 404/26 |
| 4,621,941 | 11/1986 | Ditcher et al. | 404/26 |
| 4,737,220 | 4/1988 | Ditcher et al. | 156/218 |
| 4,751,799 | 6/1988 | Ditcher et al. | 52/21 |
| 4,834,574 | 5/1989 | Bowman | 404/26 |
| 4,867,600 | 9/1989 | Bowman | 404/26 |
| 4,867,601 | 9/1989 | Bowman | 404/26 |
| 4,872,780 | 10/1989 | Bowman | 404/26 |
| 4,927,290 | 5/1990 | Bowman | 404/26 |
| 5,078,539 | 1/1992 | Claing | 404/26 |

OTHER PUBLICATIONS

"Clear-Span Manhole Adjusting Ring" literature of Cretex Specialty Products, Waukesha, Wisconsin, admitted prior art.

*Primary Examiner*—William P. Neuder

*Attorney, Agent, or Firm*—Quarles & Brady

[57] ABSTRACT

A manhole grade adjusting ring has an adjustable diameter with a V-shaped expansion lock bridging the ends of the ring. The expansion lock has radial flanges which are adjustably pinned in slots in the ends of the ring after the ring is expanded or contracted to fit a particular manhole frame using an expansion/contraction tool. The "V" is then hammered to expand the diameter of the ring so as to form a tight friction fit between the ring and the manhole frame.

15 Claims, 3 Drawing Sheets

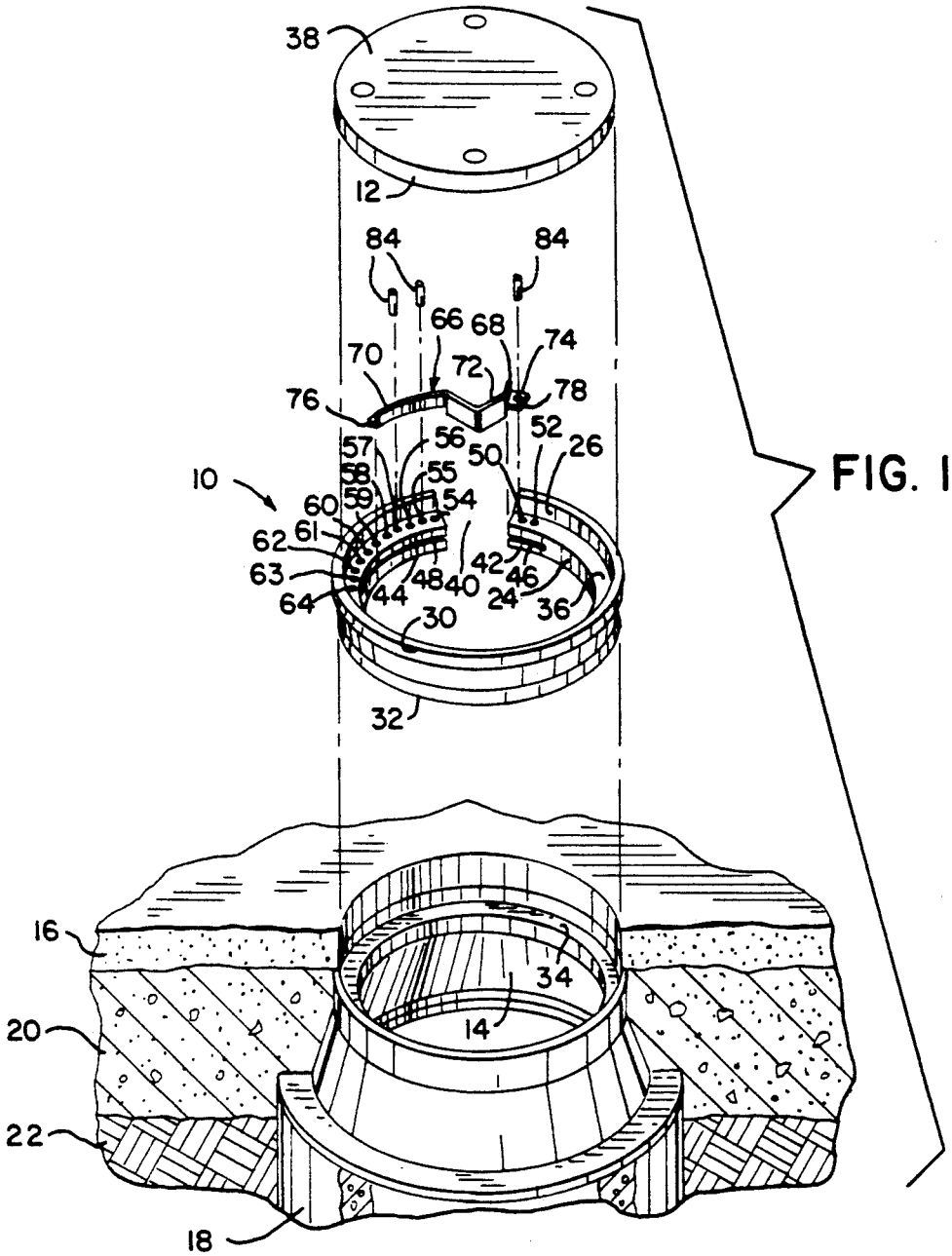
FIG. 1
FIG. 2
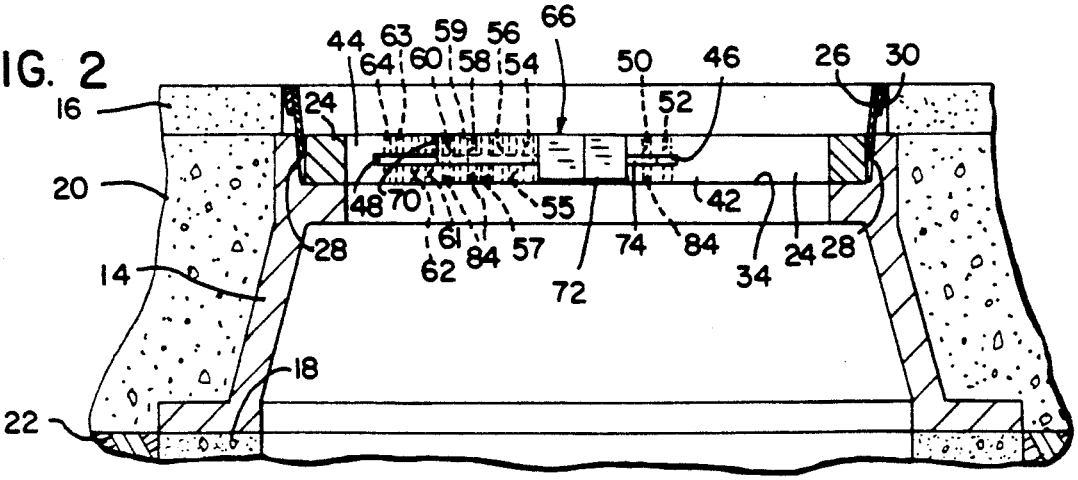

MANHOLE GRADE ADJUSTING RING AND METHOD

BACKGROUND OF THE INVENTION

1. Field of the Invention

This invention relates to devices for raising the elevation of a manhole cover, typically required prior to or after a street has been resurfaced.

2. Discussion of the Prior Art

Manholes are often constructed from a pre-cast concrete or brick and mortar chimney leading from the sanitary sewer up to about a foot beneath the surface of the roadway. On top of the chimney is placed a cast iron or steel frame, which defines the inlet to the manhole at the street level. A ledge is formed at the inlet on which rests the manhole cover.

When a street is resurfaced, the new pavement surface is usually about an inch or two above the top of the preexisting manhole frame, depending upon the thickness of the new surface. To bring the manhole cover up to the new level of the roadway, it is known to place an adjusting ring on the manhole ledge of a height equal to the new layer of pavement. The old cover is then placed inside the adjusting ring, which provides a new, higher support ledge for the cover.

One known way of securing an adjusting ring to a manhole frame is to provide a gap in the ring and weld a V-shaped expansion lock to the ends of the ring and bridging the gap. With this type of device, the adjusting ring is dropped into the old frame and the V-shaped expansion lock is hammered to flatten out the V into a locked position. This expands the ring tightly against the old frame, but only if the ring was properly sized relative to the frame in the first place. These rings therefore had to be accurately sized or they would end up too tight or too loose when the "V" was flattened or attempted to be flattened. Moreover, since manhole frame sizes are not universally standardized, these types of rings had to be carefully custom fit to specific frames.

Another type of manhole grade adjusting ring was split at one point and a "toggle" mechanism, made up of a pair of pivotally mounted bolts which could be rotated past center, bridged the split and could be hammered into place to expand the ring. This type of adjusting ring is described in U.S. Pat. No. 4,097,171. The bolts were threaded so that they could first be adjusted to the appropriate length needed to enable the mechanism to be toggled past center by hammering to expand the ring and thereby secure it to the manhole frame.

As the art developed, problems with this type of mechanism became apparent. For example, U.S. Pat. No. 4,225,226 states that such mechanisms were too expensive to manufacture and install (column 1, line 59-column 2, line 4). U.S. Pat. No. 4,225,266 also discusses (column 1, lines 36–51) that the threads could become corroded or could become loosened because of vibration caused by passing vehicles. U.S. Pat. No. 4,302,126 expands upon the problems with the device of 4,097,171, stating that it could become damaged during storage and shipment since the links flapped loosely on their pivotal mounting at such times, that the range of hole sizes was somewhat limited for the 4,097,171 device and that the toggle links could sometimes form too sharp of an angle in the disengaged position, making it extremely difficult to hammer the links past center to secure the adjusting ring.

SUMMARY OF THE INVENTION

The invention provides a manhole grade adjusting ring for installation in a manhole frame to raise the level of a manhole cover which solves the above problems. The ring has a bar portion and a skirt portion, and is split so as to define first and second ends adjacent to one another. An expansion lock has a first end, a second end and a V-shaped expansion joint between the first and second ends The first end of the expansion lock is secured to the first end of the ring with the expansion lock bridging the first and second ends of the ring and the V-shaped expansion joint pointing inward of the ring. The second end of the expansion lock is adjustably secured to the second end of the ring with means that allow the second end of the lock to be secured to the second end of the ring at different positions so as to vary the position of the first and second ends of the ring relative to one another. Thus, a manhole adjusting ring of the invention can be manufactured to a predetermined diameter, set to the required manhole diameter at the installation site using the adjustable securing means, and then fixed in place with the expansion lock.

In a preferred form, the adjustable means for securing the expansion lock and the ring includes at least one pin and holes which are registrable with one another provided in the second end of the expansion lock and in the second end of the ring to receive the pin for securing the second end of the expansion lock and the second end of the ring together. The pin connection provides a large range of adjustability at low cost.

In an especially useful form, the first end of the expansion lock is secured to the first end of the ring with a pin connection. Although this connection need not be adjustable, providing a pin connection at the first end provides for easy removal and replacement of the expansion lock.

In a preferred method of adjusting the grade of a manhole according to the invention a variable diameter manhole grade adjusting ring, which has been made to a predetermined diameter, is set into a manhole frame for which the cover is to be raised. If the adjusting ring does not fit the manhole frame properly, an adjustable connection securing the second end of the expansion lock to the ring is released (if not already released) and the ring is expanded or compressed to a diameter slightly less than the diameter of the manhole frame. The second end of the expansion lock is then secured to the ring using the adjustable connection to fix the expanded or contracted diameter of the adjusting ring at the required diameter. The expansion lock is then expanded, for example by hammering a V-shaped portion of the lock. The diameter of the adjusting ring is thereby increased so that the ring bears against the frame to produce a tight friction fit between the ring and the frame, to lock the ring in place.

Other features and advantages of the invention will become apparent from reading the detailed description of the preferred embodiment and from the drawings, a brief description of which follows.

BRIEF DESCRIPTION OF THE DRAWINGS

FIG. 1 is an exploded perspective view of a typical installation of a manhole grade adjusting ring of the present invention;

FIG. 2 is a sectional view of the manhole grade adjusting ring of FIG. 1 in a typical installation;

DETAILED DESCRIPTION OF THE PREFERRED EMBODIMENTS

Figure 3:
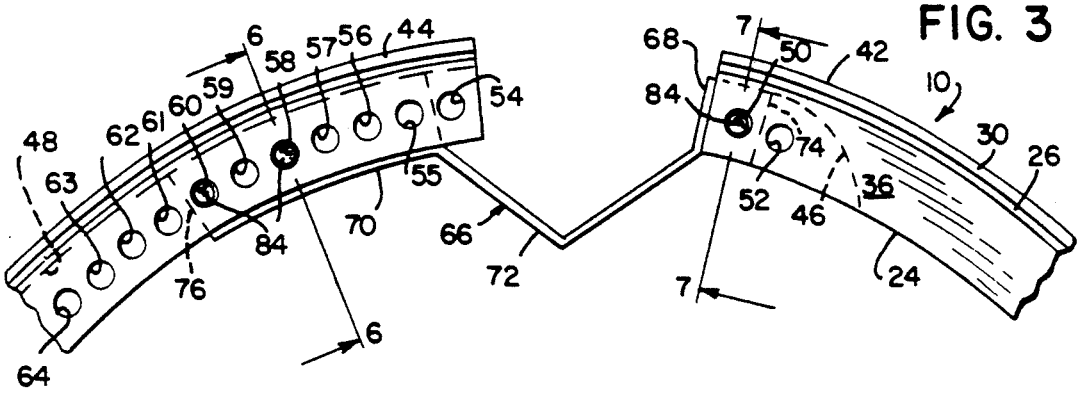
FIG. 3 is a detail top elevational view of a portion of the manhole grade adjusting ring of FIG. 1.
Figure 4:
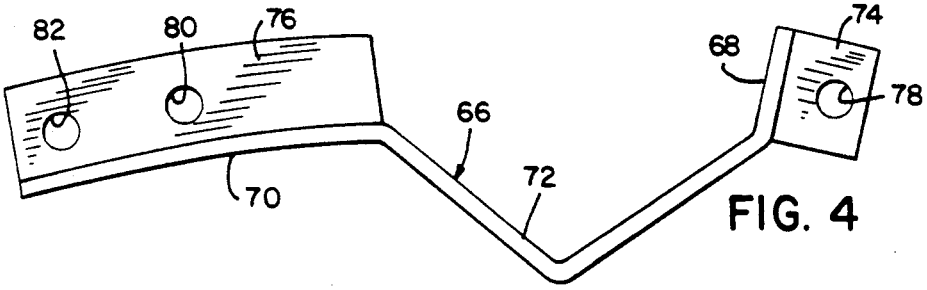
FIG. 4 is a top elevational view of an expansion lock of the manhole grade adjusting ring Of FIG. 1.
Figure 5:
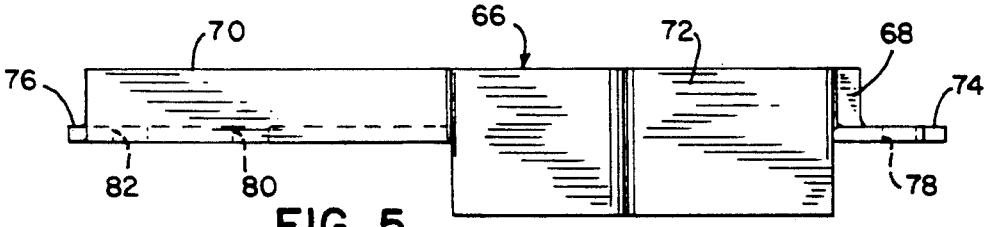
FIG. 5 is a front plan view of the expansion lock of FIG. 4.

FIG. 1 illustrates a manhole grade adjusting ring 10 of the present invention. As illustrated in FIG. 1, the ring 10 is for raising the elevation of a manhole cover 12 relative to a manhole frame 14 when a new layer 16 of pavement is applied to a roadway surface. When a new layer 16 is applied, the frame 14 remains at its previous elevation, perched on top of a manhole chimney 18 and fixed in place by the previous roadway 20, and perhaps to a certain extent the underlining substrate or earth 22 through which the manhole chimney 18 extends.

Figure 6:
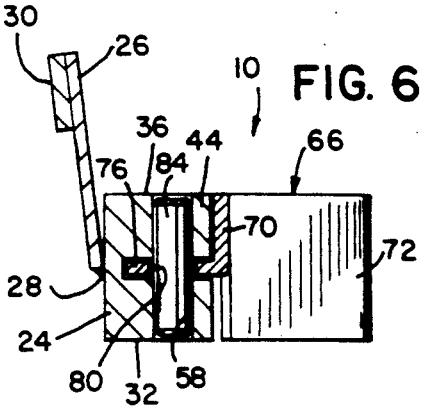
FIG. 6 is a sectional view taken from the plane of the line 6—6 of FIG. 3.
Figure 7:
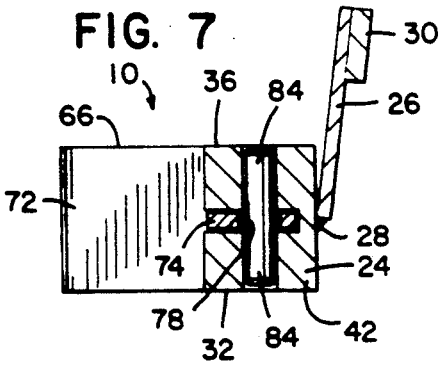
FIG. 7 is a sectional view taken from the plane of the line 7—7 of FIG. 3.

Referring to FIGS. 1-7, the ring 10 includes a circular bar portion 24, made of a bar which is square or rectangular in cross-section and is rolled to the desired diameter. The ring 10 also includes a skirt portion 26. Referring particularly to FIGS. 6 and 7, the skirt portion 26 is a steel strip rolled to the desired diameter, and welded at intermittent or continuous weld beads 28 to the outer periphery of the bar portion 24. A stiffing band 30 may also be applied on the outside, upper edge of the skirt portion 26 for additional strength and secured by any suitable means such as tacking with weld beads.

Typically, the stiffening band may be made from a ⅛ inch thick by ½ inch wide steel strip, the skirt portion from a 14 gauge steel strip, and the bar portion ¾ inch wide radially and ¾ to 2 or more inches high. It should be noted that the height of the bar portion is chosen to match the thickness of the new layer 16 of pavement (typically ¾ to 2 inches) so as to raise the cover 12 up to the level of the new layer of pavement. The lower surface of the bar portion 24, identified as the base surface 32, is supported on ledge 34 of the manhole frame 14, on which the manhole cover 12 previously rested prior to laying the new layer 16 of pavement. With the height of the bar portion 24 selected to be equal to the thickness of the new layer 16, the cover 12 can rest on platform surface 36 of the bar portion 24 and its upper surface 38 will be supported at the level of the top surface of the new layer 16.

The cover 12 sits on the platform surface 36 inside the skirt portion 26. The skirt portion 26 is angled relative to the bar portion so as to more accurately match the interior shape of the manhole frame 14 and receive the cover 12. Although manhole frames and covers vary, the skirt portion would typically flair outwardly above the bar portion at an angle of about 5 to 7 degrees from vertical. Typically, the skirt portion 26 would extend above the platform surface 36 by a distance equal to the thickness of the cover 12.

The ring 10 is split to define ends 42 and 44 adjacent to a gap 40. The first and second ends 42 and 44 are both slotted in a radial plane approximately halfway between the base surface 32 and platform surface 36 of the bar portion 24. These slots are identified respectively as 46 in the end 42 and 48 in the end 44. Two through holes 50 and 52 extend axially through the bar portion 24 from the platform surface 36, through the slot 46 and to the base surface 32 in the end 42. Eleven spaced-apart through holes 54-64 are provided in the end 44 of the bar portion 24, all of which extend axially from the platform surface 36, through the slot 48 and to the base surface 32. All the holes 50, 52 and 54-64 may typically be approximately ¼ inch diameter with the holes 54-64 being spaced at 7/16 inches on center and the holes 50 and 52 spaced approximately ½ inch on center.

The ring 10 also includes an expansion lock 66, which may typically be made of a strip of 11 gauge, A240, type 304 stainless steel. The width of the strip from which the expansion lock 66 is made is typically the same as the height of the bar portion 24. The expansion lock 66 has a first end 68, a second end 70 and a V-shaped expansion joint 72 between the first end 68 and second end 70. On each end 68 and 70 a respective flange 74 and 76 is formed. The flanges 74 and 76 are disposed in a radial plane and shaped to be received within the respective slots 46 and 48. The flange 74 has a single hole 78 which is aligned with the hole 50 when the flange 74 is received in the slot 46. The flange 76 is arcuate to conform to the interior shape of the end 44 and has two holes 80 and 82 which can be aligned with two of the holes 54-64 when the flange 76 is received in the slot 48. The holes 80 and 82 are spaced such that they are aligned with two of the holes 54-64 with one of the holes 54-64 between the two aligned holes.

Once the holes of the expansion lock 66 are aligned with the three holes in the ring 10, pins 84 are inserted through the aligned holes with a light friction fit to fix the ends 68 and 70 of the expansion lock to the respective ends 42 and 44 of the ring 10. Pinning both ends of the expansion lock 66 makes the expansion lock easily replaceable, should the ring 10 ever have to be removed and re-installed.

With the expansion lock 66 installed in the ring 10, the V-shaped expansion joint 72 points inwardly of the ring 10. When the apex of the joint 72 is hammered outwardly so as to flatten the joint 72, it expands the ring 10 and holds the ring 10 at the expanded size to secure the ring 10 in a manhole frame 14.

A manhole grade adjusting ring of the present invention need be only approximately sized to a particular manhole frame. For example, a manhole grade adjusting ring of the invention will typically fit a manhole frame which is anywhere within approximately ½ inch of the relaxed diameter of the ring. Therefore, manhole grade adjusting rings of the invention can be pre-manufactured in sizes varying in diameter in one inch increments, so that virtually any size manhole can be fitted with a pre-manufactured ring.

Figure 8:
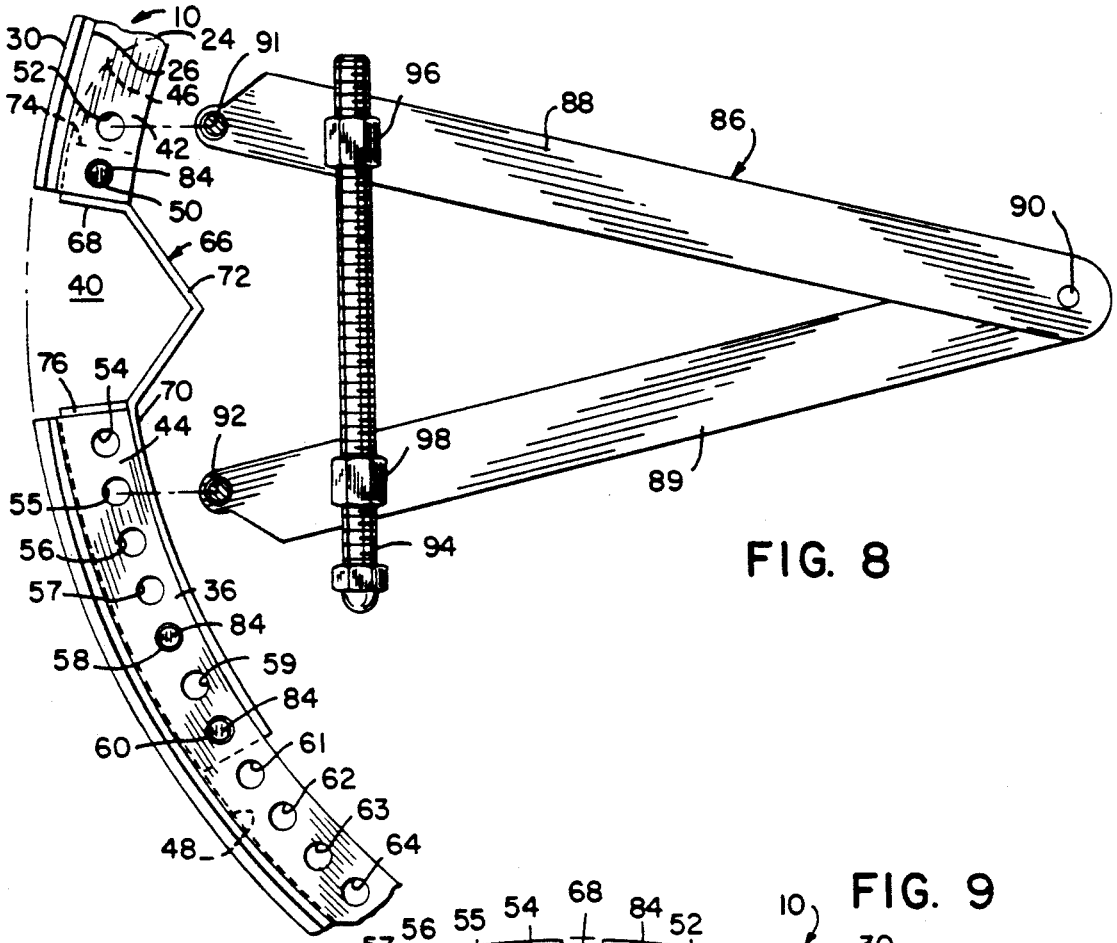
FIG. 8 is a view similar to FIG. 3 and also illustrating a tool for installing the manhole grade adjusting ring of FIG. 1.

To install a ring 10 of the invention in a manhole frame, the ring is first expanded or compressed to a diameter slightly less than the diameter of the manhole frame 14 and then placed inside the frame 14 on the ledge 34. The expansion or compression of the ring 10 can be accomplished using a tool 86 as shown in FIG. 8 having two legs 88 and 89 pivoted at hinge joint 90 and having pins 91 and 92 at their opposite respective ends. Bolt 94 is threaded into nuts 96 and 98 hinged on the respective legs 88 and 89 with the side of the bolt 94 in nut 96 being left hand threaded and the side of the bolt in nut 98 being right hand threaded. Therefore, turning the bolt 94 in one direction expands the pins 91 and 92 apart and in the other direction brings them closer together. The pins 91 and 92 are therefore placed with pin 91 in hole 52 and pin 92 in one of the other holes 54–64, preferably one adjacent the gap 40 such as 54 or 55, and the ends 42 and 44 either moved further apart or closer together to approximately fit the ring 10 to the diameter of the frame 14.

After the ring is placed on top of the ledge 34, with the first end 68 of the expansion lock 66 pinned to the first end 42 of the ring 10, the tool 86 is used to align the holes 80 and 82 of the second end 70 of the expansion lock 66 with two of the holes 54–64 in the second end 44 of the ring 10 to provide a loose but not sloppy fit of the ring 10 in the manhole frame 14. The pins 84 are then inserted through the holes 80 and 82 and the aligned two of the holes 54-64 to secure the expansion lock in the ring and hold the shape of the ring until the expansion lock is hammered. The tool 86 is then removed from the ring 10, after which the expansion joint 72 is hammered to expand the ring 10.

Hammering the expansion joint 72 typically provides an expansion in diameter of the ring 10 of up to approximately ¼ inch. Therefore, the fit of the ring 10 in the manhole frame 14 before the expansion lock 66 is expanded must place the diameter of the ring 10 within about ¼ inch of the diameter of the manhole frame 14 as measured just above the ledge 34. Hammering the expansion lock 66 to straighten the joint 72 then expands the ring 10 out against the manhole frame 14 to bear the ring 10 against the frame to produce a tight friction fit between the ring and the frame. The expansion lock 66 maintains the tight friction fit even after the impact of the hammer is relieved by virtue of being strong enough to maintain the shape into which it was pounded.

Preferably, the bar portion 24 of the ring 10 is made so that its relaxed outside diameter is approximately ⅜ inch less than the diameter of the manhole frame 14 as measured just above the ledge 34. Thus, since manhole frames are commonly made in one inch increments of diameter, e.g., nominally 22", 23", 24", etc., the bar portions 24 can also be manufactured in 1" increments, but approximately ⅜" less than the corresponding nominal manhole diameters, e.g. 21⅛" for a 22" frame, 22⅛" for a 23" frame, etc. The rings are made smaller than the corresponding frames so that in many cases the ring can simply be placed in the frame without altering the adjustment of the end 70 of the expansion lock 66. Since the skirt portion 26 adds about 3/16 inches to the diameter of the ring, expansion of the expansion lock 66 expands the ring sufficiently to fix it in the frame with a tight friction fit.

Figure 9:
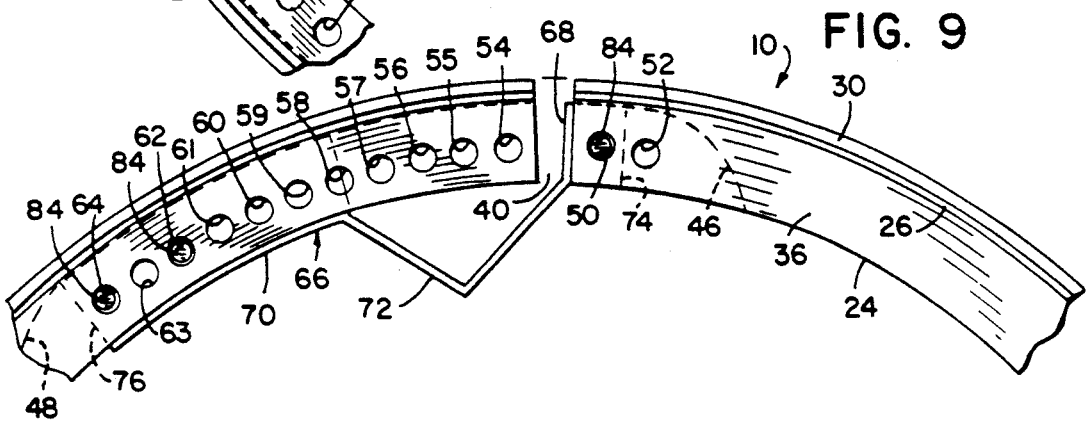
FIG. 9 is a view similar to FIG. 3 but showing the manhole grade adjusting ring contracted.
Figure 10:
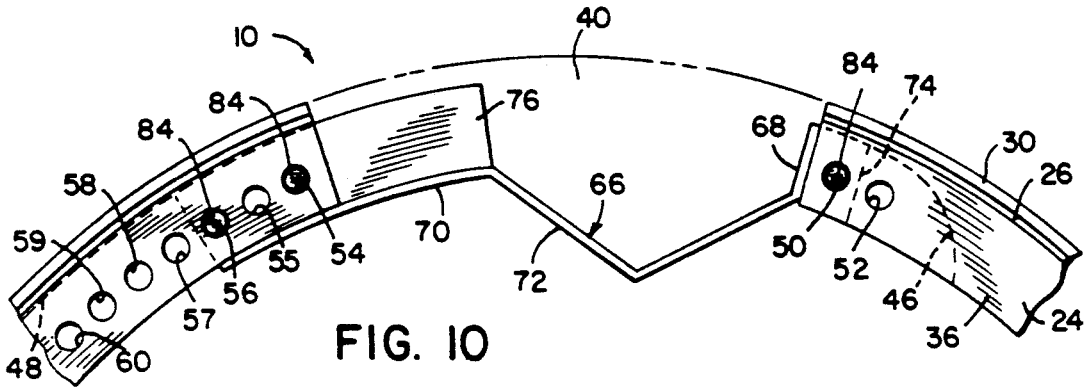
FIG. 10 is a view similar to FIG. 3 but showing the manhole grade adjusting ring expanded.

FIG. 8 illustrates the approximate position of the ends 42 and 44 with the ring 10 relaxed. In this relaxed position, the ends 42 and 44 may typically be 2 inches apart. Preferably, in this position, the holes 80 and 82 are approximately centered relative to the holes 54–64. If the holes 54–64 are 7/16 inches apart as in the preferred embodiment, from the position shown in FIG. 8 the circumference of the ring 10 can be diminished by approximately 1¾ inches to the position shown in FIG. 9 or increased by the same amount to the position shown in FIG. 10. This results in a diameter range of approximately plus or minus 0.56 inches from the relaxed diameter of the ring 10, using the hole pattern and spacing of the preferred embodiment. Note that with a range of plus or minus 0.56 inches, if the rings 10 are premanufactured in 1 inch diameter increments, the useable ranges of the rings overlap so that manhole frames sized in the overlapping range could be fitted with either of two different sized rings.

A manhole grade adjusting ring of the present invention can be constructed with no threaded connections, as in the preferred embodiment, thereby avoiding the expense and corrosion problems associated with such devices. The expansion lock of the invention also does not toggle loosely in storage or shipment so that it cannot become damaged as in prior devices. In this regard, the ring 10 can be shipped and stored with all three pins inserted with the ring in the relaxed position, and the installer could then simply drive out the two pins 84 connecting the ends 44 and 70 prior to installation, if necessary as described above.

In addition, indexing the ring to a suitable adjustment in diameter using a pin connection between the expansion lock and the ring allows a greater range of adjustment than with prior threaded adjustments so that a ring of the present invention can fit a greater range of manhole frame sizes. Moreover, the angle of an expansion lock for the invention is fixed, thereby eliminating preexisting problems in setting prior expansion devices which resulted from too sharp of an angle. Furthermore, the expansion joint for the invention is capable of bearing a compressive load in any of a number of different shapes in which it is hammered, without having to be totally flattened or hammered past its straight or center position.

Preferred embodiments of the invention have been described. Numerous modifications and variations of those embodiments will be apparent to those of skill in the art but which are still within the spirit and scope of the invention. For example, the slots 46 and 48 and flanges 74 and 76 need not be disposed in a radial plane but could be disposed so as to be received in slots opening to the platform surface 36, with the pin-engaging holes extending radially through the bar portion 24 and expansion lock 66. Also, for example, the skirt and bar portions could be formed integrally, and the end 68 of the expansion lock 66 could be welded to the corresponding end 42 of the ring 10, rather than being pinned. Therefore, the invention should not be limited by the scope of the foregoing, but only by the claims that follow.

We claim:

1. A manhole grade adjusting ring for installation in a manhole frame to raise the level of a manhole cover, comprising:

a ring including circular bar and skirt portions, said bar portion having a base surface for being supported on the manhole frame and a platform surface above said base surface for supporting the manhole cover, and said skirt portion extending above said platform surface;

wherein said ring is split so as to define first and second ends adjacent to one another;

an expansion lock having a first end, a second end and a V-shaped expansion joint between said first and second ends;

means for securing the first end of the expansion lock to the first end of the ring with the expansion lock bridging the first and second ends of the ring and the V-shaped expansion joint pointing inward of said ring; and adjustable means for securing the second end of the expansion lock to the second end of the ring, said adjustable means allowing said second end of the lock to be releasably secured to the second end of the ring at different positions on said second end of the ring so as to vary the position of the first and second ends of the ring relative to one another.

2. A manhole grade adjusting ring as in claim 1, wherein said adjustable means for releasably securing the second end of the expansion lock to the second end of the ring includes a pin and holes which are registrable with one another provided in the second end of the expansion lock and in the second end of the ring to receive said pin for securing the second end of the expansion lock and the second end of the ring together.

3. A manhole grade adjusting ring as in claim 2, wherein the bar portion at the second end of the ring is provided with a slot and the second end of the expansion lock has a flange for being received in said slot with at least one hole of said ring being aligned with at least one hole of said expansion lock.

4. A manhole grade adjusting ring as in claim 3, wherein said slot is dispersed in a radial plane approximately halfway between the base surface and the platform surface of the bar portion.

5. A manhole grade adjusting ring as in claim 4, wherein said slot opens to the inside surface of said bar portion.

6. A manhole grade adjusting ring as in claim 1, wherein said means for securing the first end of the expansion lock to the first end of the ring is releasable.

7. A manhole grade adjusting ring as in claim 6, wherein said releasable means for securing the first end of the expansion lock to the first end of the ring includes a pin and alignable holes are provided in the first end of the expansion lock and in the first end of the ring to receive said pin.

8. A manhole grade adjusting ring as in claim 7, wherein a slot is provided in the first end of the ring and a flange is provided on the first end of the expansion lock to be received in said slot with the holes in said first end of the expansion lock and in the first end of the first end of the expansion lock and in the first end of the ring being aligned to receive the pin.

9. A manhole grade adjusting ring as in claim 8, wherein said slot and flange are disposed in a radial plane.

10. A manhole grade adjusting ring as in claim 9, wherein said slot is disposed approximately halfway between the base and platform surfaces of the bar portion.

11. A manhole grade adjusting ring as in claim 10, wherein said slot opens to the inside surface of the bar portion at the first end of the ring.

12. A manhole grade adjusting ring as in claim 1, wherein the skirt portion flares outwardly as it extends above the platform surface.

13. A method of adjusting the grade of a manhole, comprising:

approximately sizing a variable diameter manhole grade adjusting ring to a manhole frame;

expanding or compressing the manhole grade adjusting ring to a diameter slightly less than the diameter of said manhole frame;

placing said manhole grade adjusting ring in said manhole frame;

securing an expansion lock to the manhole grade adjusting ring so as to fix the expanded or compressed diameter of said manhole grade adjusting ring to provide a loose fit of the ring in the manhole frame; and expanding the expansion lock to increase the diameter of the manhole grade adjusting ring so that the ring bears against the frame to produce a tight friction fit between the ring and the frame.

14. A method of installing a manhole grade adjusting ring as in claim 13, wherein the step of securing the expansion lock includes pinning at least one end of the expansion lock to the ring.

15. A manhole grade adjusting ring as in claim 13, wherein the step of expanding the expansion lock includes hammering the expansion lock to an expanded position.

* * * * *